US008552646B2

(12) United States Patent
Deng et al.

(10) Patent No.: US 8,552,646 B2
(45) Date of Patent: Oct. 8, 2013

(54) LOW T1I/LOW INI-BASED DOSE FOR DIMMING WITH MINIMAL COLOR SHIFT AND HIGH PERFORMANCE

(75) Inventors: Lei Deng, Solon, OH (US); Thomas Joseph Coffey, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 105 days.

(21) Appl. No.: 13/101,849

(22) Filed: May 5, 2011

(65) Prior Publication Data

US 2012/0280616 A1 Nov. 8, 2012

(51) Int. Cl.
*H01J 61/20* (2006.01)

(52) U.S. Cl.
USPC ..... 313/641; 313/639; 313/640

(58) Field of Classification Search
USPC ..... 313/637–643
See application file for complete search history.

(56) References Cited

U.S. PATENT DOCUMENTS

| | | | | |
|---|---|---|---|---|
| 4,020,377 | A * | 4/1977 | Popp et al. | 313/112 |
| 6,501,220 | B1 | 12/2002 | Lambrechts et al. | |
| 6,717,364 | B1 | 4/2004 | Zhu et al. | |
| 6,731,068 | B2 | 5/2004 | Dakin et al. | |
| 6,819,050 | B1 * | 11/2004 | Zhu et al. | 313/639 |
| 6,979,958 | B2 | 12/2005 | Zhu et al. | |
| 7,012,375 | B2 | 3/2006 | Brock | |
| 7,138,766 | B2 | 11/2006 | Takeuchi et al. | |
| 7,256,546 | B2 | 8/2007 | Brock et al. | |
| 7,268,495 | B2 | 9/2007 | Rintamaki et al. | |
| 7,414,368 | B2 | 8/2008 | Rintamaki et al. | |
| 7,423,380 | B2 | 9/2008 | Ota et al. | |
| 2004/0217710 | A1 * | 11/2004 | Zhu et al. | 313/639 |
| 2006/0164017 | A1 * | 7/2006 | Rintamaki et al. | 313/640 |
| 2008/0129202 | A1 * | 6/2008 | Ramaiah et al. | 313/640 |
| 2010/0006165 | A1 | 1/2010 | Banta et al. | |
| 2010/0033114 | A1 * | 2/2010 | Ramaiah | 315/326 |
| 2010/0052531 | A1 | 3/2010 | Stappers et al. | |

FOREIGN PATENT DOCUMENTS

| | | | |
|---|---|---|---|
| EP | 1473758 | A2 | 11/2004 |
| EP | 1594155 | A2 | 11/2005 |
| EP | 2428978 | A2 | 3/2012 |
| WO | 2010082144 | A1 | 7/2010 |

OTHER PUBLICATIONS

PCT Search Report and Written Opinion dated Jun. 27, 2012 from corresponding Application No. PCT/US2012/036203.

Rennilson, J. J., "Color Temperature: A Problem of Standards", Optical Spectra, Optical Pub., vol. 14, No. 10, pp. 63-66, Oct. 1, 1980.

* cited by examiner

*Primary Examiner* — Nimeshkumar Patel
*Assistant Examiner* — Christopher Raabe
(74) *Attorney, Agent, or Firm* — Fay Sharpe LLP

(57) ABSTRACT

The present disclosure relates to a discharge lamp able to be operated at less than full rated power without suffering undesirable color shift, loss of lumen maintenance or loss of lamp efficacy. It finds particular application in connection with ceramic metal halide lamps having a low dose level of thallium iodide and optionally indium iodide, e.g. less than 1 mol %, in the dose thereof.

20 Claims, 4 Drawing Sheets

LOW T1I/LOW INI-BASED DOSE FOR DIMMING WITH MINIMAL COLOR SHIFT AND HIGH PERFORMANCE

BACKGROUND OF THE DISCLOSURE

The present disclosure relates to a discharge lamp able to be operated at less than full rated power exhibiting excellent lumen maintenance and high luminous efficacy without suffering undesirable color shift. It finds particular application in connection with ceramic metal halide lamps having low thallium iodide and optionally low indium iodide in the dose thereof, and will be described with particular reference thereto.

High Intensity Discharge (HID) lamps are high-efficiency lamps that can generate large amounts of light from a relatively small source. These lamps are widely used in many applications, including retail display lighting, highway and road lighting, lighting of large venues such as sports stadiums, floodlighting of industrial and commercial buildings and shops, and projectors, to name but a few. The term "HID lamp" is used to denote different kinds of lamps. These include mercury vapor lamps, metal halide lamps, and sodium lamps. Metal halide lamps, in particular, are widely used in areas that require a high level of brightness at relatively low cost. HID lamps differ from other lamps because their functioning environment requires operation at high temperature and high pressure over a prolonged period of time. Also, due to their usage and cost, it is desirable that these HID lamps have relatively long useful lives and produce a consistent level of brightness and color of light. Although in principle HID lamps can operate with either an alternating current (AC) supply or a direct-current (DC) supply, in practice, the lamps are usually driven via an AC supply.

Discharge lamps produce light by ionizing a vapor fill material, such as a mixture of rare gases, metal halides and mercury, with an electric arc passing between two electrodes. The electrodes and the fill materials are sealed within a translucent or transparent discharge vessel that maintains the pressure of the energized fill materials and allows the emitted light to pass through it. The fill materials, also known as the lamp "dose," emit a desired spectral energy distribution in response to being excited by the electric arc. For example, halides provide spectral energy distributions that offer a broad choice of light properties, e.g. color temperatures, color renderings, and luminous efficacies.

Given current awareness in society surrounding the use of energy in a more efficient and economical manner, there is an increasing interest in the lighting industry to provide lamps capable of operation with reduced energy consumption, optimally without sacrificing lamp performance and particularly without undergoing an undesirable color shift. One solution would be to operate lamps at a reduced power level. The potential savings in energy consumption for commercial lighting purposes, as well as the opportunity to reduce consumption of our energy resources as a society, are substantial.

At least one drawback exists, however, in operating ceramic metal halide (CMH) lamp lighting at less than its full power rating. As the operating lamp power level is reduced, the color of emitted light shifts from white to green, correlating to an increase in the correlated color temperature (CCT) of the lamp by as much as 1000° K or more. CMH lamp color is primarily decided by the halide dose composition in the vapor phase in the arc tube. A typical CMH lamp, for example, contains NaI, TlI, CaI2 and one or more rare earth iodides, such as DyI3, HoI3, TmI3. When the CMH lamp is dimmed, the halide vapor pressure in the arc tube will drop with the reduction of arc tube temperature. However, the TlI vapor pressure drops more slowly than that of the rare earth halides. Because the TlI emits green light, and remains at a relatively high vapor pressure as compared to the other halides in the fill, the light emitted by the lamp exhibits a color shift from white to green at dimmed conditions. Such a shift in light color may have a considerable impact on commercial usage. For example, retail and display venues, which often employ CMH lamps due to their long life and focused light emissions, can suffer considerably from lighting that does not present items being displayed to their best advantage, i.e., under white light. The same is true for public venues where lighting contributes to the atmosphere or ambiance experienced by customers.

With current technology, lamp chemistries provide very beneficial properties on most performance metrics. However, when lamps are operated at reduced power to reduce energy consumption, these performance metrics may be altered, and specifically the color of the emitted light may be negatively affected, i.e. a color shift may occur. Attempts have been made to reduce the undesirable color shift that occurs when operating a lamp at less than 100% of its power rating by altering dose chemistry, but often these attempts if successful at reducing color shift have often resulted in other lamp metrics suffering. In other words, there is generally a trade-off in another performance parameter when the dose is changed to optimize a desired lamp characteristic. For example, in some instances where desirable emission color was retained, the lamp suffered from reduced efficacy and/or poor lumen maintenance over the life of the lamp. These parameters relate directly to the color of light emitted by the lamp, and therefore directly affect the satisfaction of the consumer using the lamp. Therefore, efforts aimed at solving emission color problems by changing the lamp dose have resulted in losses, and sometimes substantial losses, with regard to other performance and photometric parameters, even when the change in dose chemistry has been minimal. In most instances efforts to improve lamp color have done so at the expense of other important lamp parameters.

For example, U.S. Pat. No. 6,501,220, U.S. Pat. No. 6,717,364 and U.S. Pat. No. 7,012,375, disclose a TlI-free lamp dose that includes DyI3, TmI3 or HoI3, which are known to interrupt the tungsten halogen cycle in the CMH lamps. As a result, these lamps have reduced lumen maintenance. In addition, some of the above patents contain $MgI_2$, which may prove beneficial with regard to dimming characteristics including no or substantially no color shift, but also causes reductions in lamp efficacy and lumen maintenance. So far, there is lacking a CMH lamp dose that can provide excellent dimming characteristics and at the same time provide good lumen maintenance and efficacy. The foregoing drawbacks have been a limiting factor to the widespread use of CMH lamps under dimming, energy saving conditions.

There exists, therefore, a need for a lighting solution that can be operated at less than nominal power, i.e. under dimming, in a more energy efficient manner without suffering a loss of the perceived white color of the emitted light, particularly without causing a shift toward a more green hue of emitted light, without reducing lumen maintenance, and without detracting from lamp efficacy. What is desired is a lamp capable of operating, at the consumer's choice, at a reduced power rating, up to as much as 50% less power, while maintaining a white light emission, good lumen maintenance and efficacy of the lamp.

Unexpectedly, the present invention achieves all of the foregoing desirable parameters, while causing no or only negligible losses in other performance and photometric parameters of the lamp. This is accomplished by employing a lamp dose including thallium iodide in an amount less than 1 mol % and, optionally, indium iodide also as less than 1 mol %, based on the entire halide till, with an optimization of other halides compositions. The result is a lamp exhibiting excellent performance with regard to lumens, efficacy, and exhibiting no perceived color shift.

SUMMARY OF THE DISCLOSURE

In an exemplary embodiment, a lamp includes a discharge vessel having sealed therein an ionizable fill including at least an inert gas, mercury, and a halide component having less than 1% thallium and, optionally, less than 1% indium, based on the entire halide mole % present therein, the remaining halide component including an alkali metal halide, an alkaline earth metal halide, and a rare earth halide. For example, the halide component may include less than 1 mol % thallium halide, optionally less than 1 mol % indium halide, sodium halide, at least one of calcium or strontium halide, and at least one of cerium or lanthanum halide.

In yet another embodiment of the invention, a method of forming a lamp is provided. The method includes providing a discharge vessel having sealed therein an ionizing this fill including an inert gas, mercury, an alkali metal halide, an alkaline earth metal halide, and a rare earth halide including at least one of La or Ce. The halide component, for example, may include less than 1 mol % thallium halide, less than 1 mol % indium halide, sodium halide, at least one of a calcium halide and strontium halide, and at least one of a rare earth halide selected from the group consisting of lanthanum and cerium. The method further includes positioning electrodes within the discharge vessel to energize the fill in response to a voltage applied thereto. It will be appreciated that the current invention is not limited to any particular manufacturing method or processing.

A primary benefit realized by the lamp according to an embodiment of the invention is enhanced color of emitted light when the lamp is operated at less than the full power rating of the lamp, typically at a reduction of about 50% of full rated power, with no perceivable color shift, primarily due to the inclusion of only a low amount of thallium iodide, i.e., up to about 1 mol %, and optionally a low amount of indium iodide, i.e., up to about 1 mol %, based on the entire mol % of halides in the fill.

Another benefit realized by the lamp according to an embodiment of the invention is enhanced lumen maintenance of 15% or greater after 3000 hours of operation over prior art CMH lamps, i.e. while other lamps show a drop in lumen maintenance the current lamp exhibits 85% lumen maintenance.

Yet another benefit realized by the lamp according to an embodiment of the invention is enhanced efficacy, in excess of 90 LPW.

Other features and benefits of the lamp according to the invention will become more apparent from reading and understanding the following detailed description.

DETAILED DESCRIPTION OF THE PREFERRED EMBODIMENTS

Figure 1:
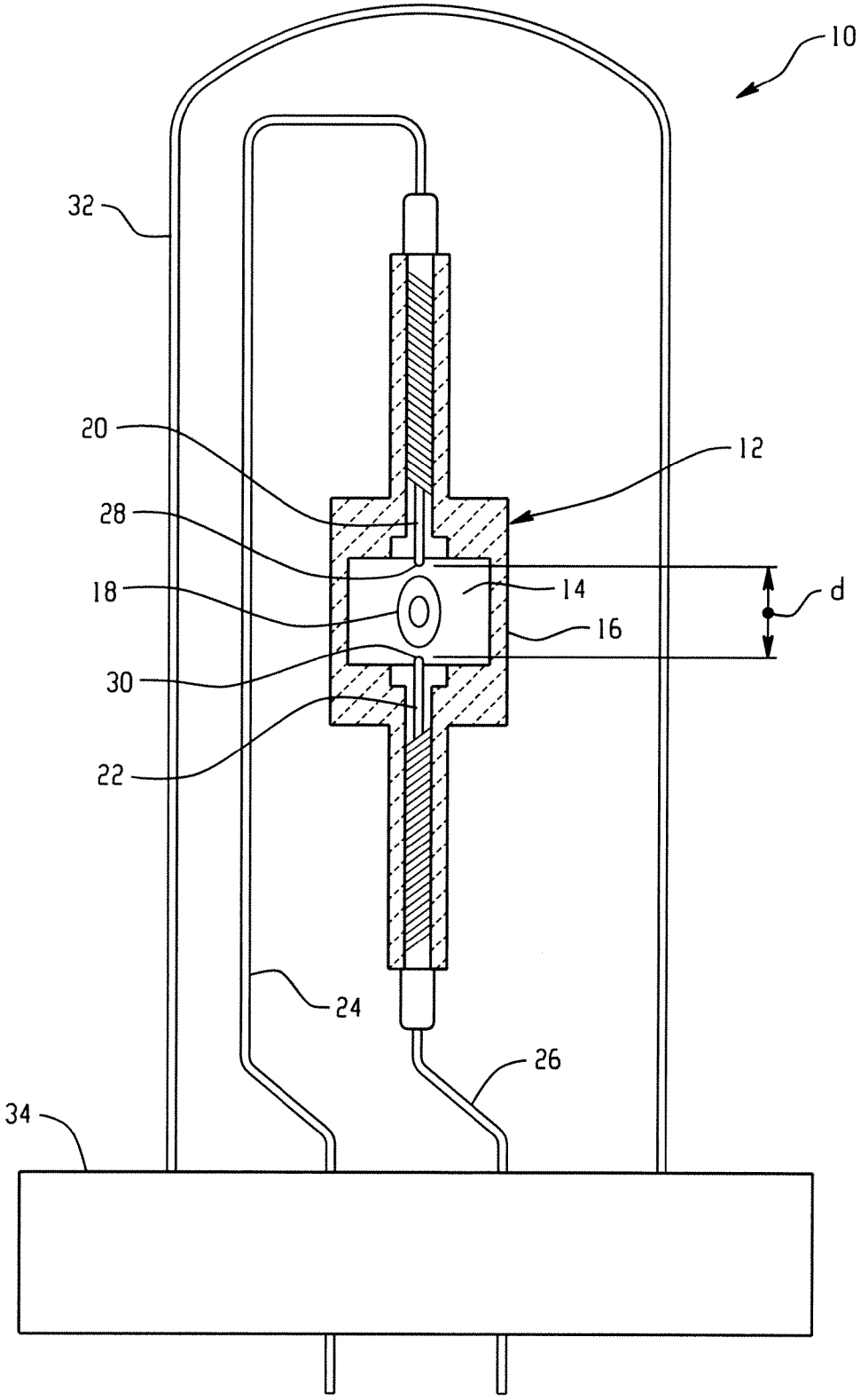
FIG. 1 is a cross-sectional view of an HID lamp according to an exemplary embodiment.

The present disclosure relates to a discharge lamp able to be operated at less than full rated power without suffering undesirable color, shift, loss of lumen maintenance or loss of lamp efficacy. It finds particular application in connection with ceramic metal halide lamps including a dose containing low thallium iodide and optionally a low indium iodide mole fraction, i.e., up to about 1 mol %, wherein the lamp when operated at less than its nominal lamp power, for example 50%, e.g. as low as 40% nominal power, exhibits substantially no color shift, good lumen maintenance and good efficacy. It is understood that while the following disclosure may at times exemplify a 70 W CMH lamp or 70 W Ultra lamp, the novel dose composition provided has equal benefits in most, if not all, CMH lamp designs.

In an exemplary embodiment, a lamp includes a discharge vessel having sealed therein an ionizable fill including at least an inert gas, mercury, and a halide component having low thallium iodide and optionally low indium iodide included therein, i.e. less than 1 mol % of each, and further including an alkali metal halide, an alkaline earth metal halide, and a rare earth halide. For example, the halide component may include sodium halide, at least one of calcium or strontium halide, at least one of cerium or lanthanum halide, and less than 1 mol % thallium halide and indium halide. The lamp including less than 1 mol % thallium halide exhibits no perceivable color shift when operated at less than nominal lamp power, even as low as 50% nominal power. While indium iodide is not required to be present, the inclusion thereof as less than 1 mol % of the halide fill is shown to further enhance the photometric and performance parameters of the lamp.

In one embodiment there is provided a discharge lamp in accord with the foregoing that exhibits lumens per watt (LPW) of more than 90, and preferably as high as 94, and further exhibits lumen maintenance of greater than about 93% after 3000 hours of operation. The lamp CCT shifts less than +/−250K when operated at a reduced power level, as low as about 50% of the rated lamp power. As used herein, the term "rated power", "nominal lamp power" and "lamp power rating", or any version thereof, which may be used interchangeably, refers to the optimum wattage at which the lamp is intended to be operated, in accord with industry standards. In this regard, for example, incandescent lamps may be marketed as 100 W, 70 W or 50 W lamps, the watts (W) indicating the full power rating of the lamp. Likewise, HID lamps may commonly be marketed as 150 W, 100 W, 70 W, 50 W, 39 W and 20 W lamps.

In another embodiment, there is provided a ceramic metal halide lamp which, when operated at less than 80% of its nominal lamp power, and even at less than about 50% of its nominal lamp power, exhibits a CCT substantially the same as, or within about +/−100° K of, the CCT of the lamp if operated at 100% of its nominal lamp power. Therefore, due to the fact that the CCT remains substantially the same, the color of light emitted by the lamp does not undergo a perceivable shift. In addition to the foregoing, the lamp in accord with at least one embodiment of the invention exhibits excellent lumen output and efficacy. The CMH lamp demonstrating these characteristics includes a dose including less than 1 mol % thallium iodide, optionally less than 1 mol % indium iodide, sodium halide, calcium and/or strontium halide, and at least one of cerium or lanthanum halide. As such, the following disclosure provides for a lamp having improved efficacy and better color performance than other comparable lamps currently available, even when such lamp is operated at less than its nominal lamp power.

As described in various aspects, the lamp is able to simultaneously satisfy photometric targets without compromising targeted reliability or lumen maintenance. Photometric properties that are at least satisfactorily achieved, and in some instances enhanced, in a lamp design in accord herewith include initial lumen output, lumen maintenance (LPW) and CCT, among others.

Taking into consideration the following photometric and performance parameters, including Lumens, CRI, CCT, Dccy, CCT shift, and CRI shift, the halide dose compositions, shown as mol %, in TABLE 1 below were tested to determine the optimum dose content to achieve the desired goal. All lamp doses included 70 mol % sodium iodide and 24 mol % calcium iodide, in addition to the other halides shown. Optimization of different parameters was determined for each dose composition. Sample 13 included $LaI_3$ in place of NaI and sample 14 included $SrI_2$ in place of $CaI_2$. No composition was found to satisfy all parameters to the optimum. However, taking into account the results of the testing, it was possible to arrive at a lamp providing for the most optimum performance regarding color shift, while maintaining other performance parameters. In light of the data shown, it has been determined that a halide dose including less than 1 mol % of each of TlI and InI provides the best results. This dose may also include from 3.0-6.0 mol % $CeI_3$. Further test data is provided to support this conclusion below and in the FIGURES.

TABLE 1

| SAMPLE | TlI | InI | $CeI_3$ | NaI | $CaI_2$ |
|---|---|---|---|---|---|
| 1 | 0.4 | 1.6 | 4.0 | 70 | 24 |
| 2 | 0.8 | 0.6 | 4.6 | 70 | 24 |
| 3 | 0.6 | 2.4 | 3.0 | 70 | 24 |
| 4 | 0.9 | 1.1 | 4.1 | 70 | 24 |
| 5 | 0.0 | 3.0 | 3.0 | 70 | 24 |
| 6 | 1.2 | 1.8 | 3.0 | 70 | 24 |
| 7 | 0.0 | 1.0 | 5.0 | 70 | 24 |
| 8 | 0.0 | 1.5 | 4.5 | 70 | 24 |
| 9 | 0.6 | 0.0 | 5.0 | 70 | 24 |
| 10 | 0.0 | 0.0 | 6.0 | 70 | 24 |
| 11 | 1.2 | 0.0 | 4.8 | 70 | 24 |
| 12 | 0.8 | 0.6 | 4.6 | 70 | 24 |
| 13 | 0.8 | 0.6 | $LaI_3$ 4.6 | 70 | 24 |
| 14 | 0.8 | 0.6 | 4.6 | 70 | $SrI_2$ 24 |

The term "lumen" refers herein to the total amount of visible light emitted from a source, in this instance a CMH lamp. The efficacy of the lamp, or the luminous efficacy, is the ratio of luminous flux, in lumens, to power, usually measured in watts. Generally, in measuring the output of a light source, or in measuring how well the source provides visible light from a given amount of electricity, the emission is measured in lumens per watt, LPW. Put another way, luminous efficacy represents the ratio between the total luminous tlux emitted by a device (lumens) and the total amount of input power consumed by the device (watts). Some of the input energy is lost in the form of heat or other than visible light radiation.

Correlated color temperature or CCT refers to the absolute temperature, expressed in degrees Kelvin (K), of a black body radiator when the chromaticity (color) of the black body radiator most closely matches that of the light source. CCT may be estimated from the position of the chromatic coordinates (u, v) in the Commission Internationale de l'Eclairage (CIE) 1960 color space. From this standpoint, the CCT rating is an indication of how "warm" or "cool" the light source is. The higher the number, the cooler the lamp. The lower the number, the warmer the lamp. An exemplary lamp may provide a correlated color temperature (CCT) between for example, about 2700K and about 4500K, between about 3300K and about 2900K, e.g., 3000K. For example, a CMH lamp having a conventional fill composition including NaI, $CaI_2$, TlI in excess of 3 mol %, and $LaI_3$, along with an inert gas and Hg, may operate at a CCT of about 3000° K at its nominal lamp power of 70 W. This same lamp, having the same fill, however, when operated at a reduced lamp power, experiences an increase in CCT, such that when operated at about 50% of its nominal lamp power, the CCT increases to about 4400° K. This rise in CCT of approximately 1400° K corresponds to a color shift from white toward green. If, however, a lamp in accord with at least one embodiment hereof, having only a very low amount of thallium iodide and indium iodide in its dose composition, i.e. less than 1 mol % of TlI and optionally less than 1 mol % InI, and further including NaI, $CaI_2$ and/or $SrI_2$, and $LaI_3$ and/or $CeI_3$, is similarly tested, at 100% of its nominal lamp power it exhibits a CCT of 3000° K and at 50% of its nominal lamp power it exhibits a CCT of only about 3100° K. This slight increase in CCT of about 100° K, from 3000° K to 3100° K, does not cause a color shift large enough to be perceived by most consumers. Therefore, a lamp in accord with the invention provides improved color quality of emitted light at reduced power, making the lamp an energy efficient lighting choice. The foregoing is merely exemplary and is provided merely to demonstrate how the subject lamp dose renders improved color quality. As such, it should be appreciated that the present invention is in no way limited to the specific embodiments described above, and various modifications thereof, including tills and temperatures, are contemplated herein.

Another measure of light color, Dccy, is the difference in chromaticity of the color point of the lamp on the Y axis (CCY), from that of the standard black body curve. Color points for a single lamp, measured at different operating powers starting at 100% nominal lamp power, followed by reductions to 80%, 70%, 60% and 50%, must remain within what is commonly known as a "MacAdam Ellipse" for the emitted color to be perceived as unchanging. The term MacAdam ellipse refers to the region on a conventional chromaticity diagram, which contains all colors that are indistinguishable to the average human eye from the color at the center of the ellipse. The ellipses were developed using matches made by independent observers of color points. MacAdam observed that all of the matches made by the observers fell into an ellipse for that color on the CIE 1931 chromaticity diagram. The measurements were made at 25 points on the chromaticity diagram, and it was found that the size and orientation of the ellipses on the diagram varied widely depending on the test color. Generally, it is understood that a difference in color points of more than 6 MPCD (minimum perceivable color difference) indicates a perceivable shift in the color of emitted light.

Yet another commonly used color indicator is the color rendering index (CRI). CRI is an indication of a lamp's ability to show individual colors relative to a standard, and is derived from a comparison of the lamp's spectral distribution compared to that standard (typically a black body) at the same color temperature. There are fourteen special color rendering indices (Ri where i=1-14) which define the color rendering of a light source when used to illuminate standard color tiles. The general color rendering index (Ra) is the average of the first eight special color rendering indices (which correspond to non-saturated colors) expressed on a scale of 0-100. Unless otherwise indicated, color rendering is expressed herein in terms of the "Ra". The color rendering index of a conventional 70 W CMH lamp, having a fill comparable to that of a lamp in accord herewith, but including greater amounts of thallium iodide and indium iodide may be in the range of about 80 to 90. As noted earlier, prior attempts to avoid a color shift in emitted light at reduced operating power have included removing TlI from the dose. These attempts have resulted, however, in lamps exhibiting a CRI of well below 80. In contrast, the lamp having a dose including a very low amount of thallium iodide or indium iodide, and including the remaining halide dose components as set forth herein, has been shown to exhibit a CRI of as high as 86. It is understood in the industry that a CRI of anything greater than about 80 is considered excellent.

These ranges and parameters, i.e., consistent CCT within +/−250° K, of about 3000° K, and CRI of at least about 86, may be simultaneously satisfied by the present lamp design when operated at or below 80% of the lamps nominal power rating. Unexpectedly, this can be achieved without negatively impacting lamp efficacy and lumen maintenance. Thus, for example, the exemplary lamp may exhibit a CCT, CRI and color point correlating to improved color quality, i.e., white light emission, and yet maintain lumen efficacy and lamp life in accord with known, desirable standards, while operating at reduced nominal lamp power of less than 80%, and even as low as about 50%, e.g. about 45%.

In one embodiment, a lamp including a discharge vessel and electrodes extending into the discharge vessel is provided. The lamp further includes an ionizable fill sealed within the vessel. The ionizable fill contains a very low dose amount of thallium and indium iodides, i.e. less than about 1 mol %. It has been realized herein that by reducing the amount of thallium iodide, and indium iodide if present, in the dose equal to or less than 1% of the halide fill (mole fraction), and by further including halide dose components in accord with the following, the foregoing parameters relating to emission color and performance can be advantageously achieved. The ionizable fill of this advantageous CMH lamp includes an inert gas, Hg, and a further halide component including an alkali metal halide, at least one alkaline earth metal halide, and at least one rare earth halide.

With reference to FIG. 1, a cross-sectional view of an exemplary HID lamp 10 is shown. This lamp may be, for example, the type referred to commonly as a 70 W Ultra CMH lamp. It is understood, however, that any lamp type using an ionizable fill will benefit from the following disclosure. The lamp includes a discharge vessel or arc tube 12, which defines an interior chamber 14, and may be enclosed in shroud or outer envelope or jacket 32. The discharge vessel wall 16, may be formed of a ceramic material, such as alumina, or other suitable light-transmissive material, such as quartz glass. An ionizable fill 18 is sealed in the interior chamber 14. Electrodes 20, 22, which may be formed from tungsten, are positioned at opposite ends of the discharge vessel so as to energize the fill when an electric current is applied thereto. The two electrodes 20 and 22 are typically fed with an alternating electric current, through base 34, via conductors 24, 26 (e.g., from a ballast, not shown). Tips 28, 30 of the electrodes 20, 22 are spaced by a distance, d, which defines an arc gap. When the lamp 10 is powered, indicating a flow of current to the lamp, a voltage difference is created across the two electrodes. This voltage difference causes an arc across the gap between the tips 28, 30 of the electrodes. The arc results in a plasma discharge in the region between the electrode tips 28, 30. Visible light is generated and passes out of chamber 14, through wall 16. It is understood that any suitable lamp configuration may be used in carrying out the subject invention, FIG. 1 being only one such configuration.

The ionizable fill 18 includes an inert gas, mercury (Hg), and a halide dose that includes up to 1 mol % thallium iodide and optionally up to 1 mol % indium iodide. The halide component includes a rare earth halide and may further include one or more of an alkali metal halide and an alkaline earth metal halide. In operation, the electrodes 20, 22 produce an arc between tips 28, 30 of the electrodes that ionizes the fill to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber. Further, when the lamp is operated at less than its nominal lamp power, these parameters combine to affect significantly the color of the light emitted from the lamp. By reducing the amount of thallium iodide and indium iodide in the halide dose, it is possible to positively affect lamp performance at lower than nominal lamp power, thus generating energy savings, without any loss of performance, and in some instances generating improved lamp performance. In the following description of the fill, the amounts of the components refer to the amounts initially sealed in the discharge vessel, i.e., before operation of the lamp, unless otherwise noted.

The buffer gas may be an inert gas, such as argon, xenon, krypton, or a combination thereof, and may be present in the till at from about 2-20 micromoles per cubic centimeter ($\mu mol/cm^3$) of the interior chamber 14. The buffer gas may also function as a starting gas for generating light during the early stages of lamp operation. In one embodiment, suited to CMH lamps, the lamp is backfilled with Ar. In another embodiment, Xe or Ar with a small additional amount of Kr85 is used. The radioactive Kr85 provides ionization that assists in starting the lamp. The cold fill pressure may be about 60-300 Torr, although higher cold fill pressures are not excluded. In one embodiment, a cold fill pressure of at least about 240 Torr is used. Too high a pressure may compromise lamp start-up. Too low a pressure can lead to increased lumen depreciation over the life of the lamp.

The mercury dose may be present at from about 2 to 35 $mg/cm^3$ of the arc tube volume. The mercury weight is adjusted to provide the desired arc tube operating voltage for drawing power from the selected ballast.

The halide dose of the lamp in accord herewith includes only up to about 1 mol % thallium iodide and optionally up to about 1 mol % indium iodide as part of the halide dose. As was noted above, it has been known to remove thallium halide completely from the dose materials. However, those lamps not including thallium halide, particularly thallium iodide, have experienced a decrease in lamp efficacy, rendering the use of thallium halide desirable. The need to include thallium iodide must be balanced with its known propensity to affect a color shift of the emitted light when the lamp is operated at less than nominal power, e.g. at 80% or lower nominal power. Conventional CMH lamps have included much greater than 1 mol % of TlI, for example up to 5 mol % and even higher. It has now been unexpectedly realized, however, that by limiting the amount of thallium halide, for example TlI, in the dose to less than about 1 mol % and by optionally adding an equally low amount of indium halide, i.e., less than about 1 mol %, it is possible to achieve a lamp having no deleterious effect on photometric lamp properties. As has been noted earlier herein, the lamp not having indium halide in a low dose amount, i.e. containing only less than 1 mol % TlI, exhibits improved performance under dimming conditions. The addition of a low dose amount of indium halide, preferably indium iodide, however, has been shown to further enhance the lamp performance. In addition, carefully choosing the remaining dose constituents in accord herewith enhances lamp performance. As such, it has now been determined that a CMH lamp having the following dose components, when operated at less than nominal operating power, less than 80%, e.g. 50%, exhibits no undesirable color shift, no reduction in lumen maintenance, and good luminous efficacy. The dose includes less than 1 mol % of thallium iodide and optionally less than 1 mol % indium iodide, and further includes $NaI_2$, $CaI_2$, and/or $SrI_2$, and $CeI_3$ and/or $LaI_3$.

The halide(s) in the halide component can each be selected from chlorides, bromides, iodides and combinations thereof. In one embodiment, the halides are all iodides. Iodides tend to provide longer lamp life, as corrosion of the arc tube and/or electrodes is lower with iodide components in the fill than with otherwise similar chloride or bromide components. The halide compounds will usually be present in stoichiometric relationships.

The rare earth halide of the halide component may include halides of at least lanthanum (La) and cerium (Ce), and may further include halides of praseodymium (Pr), europium (Eu), neodymium (Nd), samarium (Sm), and combinations thereof. The rare earth halide(s) of the fill can have the general form $REX_3$, where RE is selected from La and Ce, and optionally from Pr, Nd, Eu, and Sm, and X is selected from Cl, Br, and I, and combinations thereof, and may be present in the fill at any suitable concentration as known to those skilled in the art. Exemplary rare earth halides from this group are lanthanum halide and cerium halide. The fill will generally contain at least one of these halides, with the rare earth halide molar concentration being at least 1%, at least about 3%, e.g. about 4.8% of the total halides in the fill.

The alkali metal halide, where present, may be selected from Lithium (Li), sodium (Na), potassium (K), and cesium (Cs) halides, and combinations thereof. In one specific embodiment, the alkali metal halide includes sodium halide. The alkali metal halide(s) of the fill can have the general form AX, where A is selected from Li, Na, K, and Cs, and X is as defined above, and combinations thereof, and may be present in the fill at a suitable concentration as known to those skilled in the art.

The alkaline earth metal halide, where present, may be selected from calcium (Ca), barium (Ba), and strontium (Sr) halides, and combinations thereof. The alkaline earth metal halide(s) of the fill can have the general form $MX_2$, where M is selected from Ca, Ba, and Sr, and X is as defined above, and combinations thereof. In one specific embodiment, the alkaline earth metal halide includes calcium halide. In another embodiment the alkaline earth metal halide includes strontium halide. The alkaline earth metal halide may be present in the fill at any suitable concentration as known to those skilled in the art. The alkaline earth metal halide component does not, however, include $MgX_2$. It is our understanding that use of the same may result in decreased lumen maintenance when the lamp is operated at nominal or less than nominal lamp power, or may inhibit initial lamp lumen efficacy.

In one embodiment, the till comprises:

0.1-1 mol % thallium halide, 68-72 mol % of alkali metal halide, 10-25 mol % of alkaline earth metal halide, and 2-6 mol % of rare earth halide, wherein the halide components are selected to be consistent with the foregoing disclosure.

In one embodiment, the fill comprises:

0.1-1 mol % thallium halide, 0.1-1 mol % indium halide, 68-72 mol % of alkali metal halide, 10-25 mol % of alkaline earth metal halide, and 2-6 mol % of rare earth halide, wherein the halide components are selected to be consistent with the foregoing disclosure.

In another embodiment, the fill comprises:

0.1-0.9 mol % thallium halide, 0.1-0.9 mol % indium halide 68-72 mol % of alkali metal halide, 10-25 mol % of alkaline earth metal halide, 2-6 mol % of rare earth halide, and at least 1.0 mol % cesium halide, wherein the halide components are selected to be consistent with the foregoing disclosure.

All of the foregoing ranges, for not only dose composition but also color parameters, may be simultaneously satisfied in the present lamp design. Unexpectedly, this can be achieved without negatively impacting lamp reliability or lumen maintenance. Thus, for example, the exemplary lamp may exhibit a CCT, CRI and color point correlating to improved color quality, i.e., white light emission, and yet maintain lumen output and lamp life in accord with or better than known, desirable standards, while being operated at less than nominal lamp operating power.

TABLE 2 below provides the halide dose content, in mole fractions, for the lamps used to generate data for the following graphs. It is noted that Lamp A, in accord with the invention, includes less than 1 mol % thallium iodide and indium iodide. Lamp B, also in accord with the invention, includes less than 1 mol % thallium iodide and indium iodide. Lamp C, however, is a commercially available 70 W Ultra lamp including a halide dose having a thallium iodide content of 4.2 mol %, well above the desired 1 mol % upper limit, and no indium iodide. Lamp D is a commercially available 150 W lamp including a halide dose having a thallium iodide content of 4.0 mol %, well above the desired 1 mol % upper limit, and no indium iodide.

TABLE 2

| | MOL % | | | | | | | |
|---|---|---|---|---|---|---|---|---|
| LAMP | NaI | $CaI_2$ | $CeI_3$ | $TmI_3$ | $LaI_3$ | $SrI_2$ | TlI | InI |
| A | 70.0% | \ | 4.6% | \ | \ | 24.0% | 0.8% | 0.6% |
| B | 70.0% | 24.0% | 4.6% | \ | \ | \ | 0.8% | 0.6% |
| C | 71.2% | 18.0% | \ | \ | 6.6% | \ | 4.2% | \ |
| D | 72.0% | 18.0% | \ | 6.0% | \ | \ | 4.0% | \ |

Figure 2:
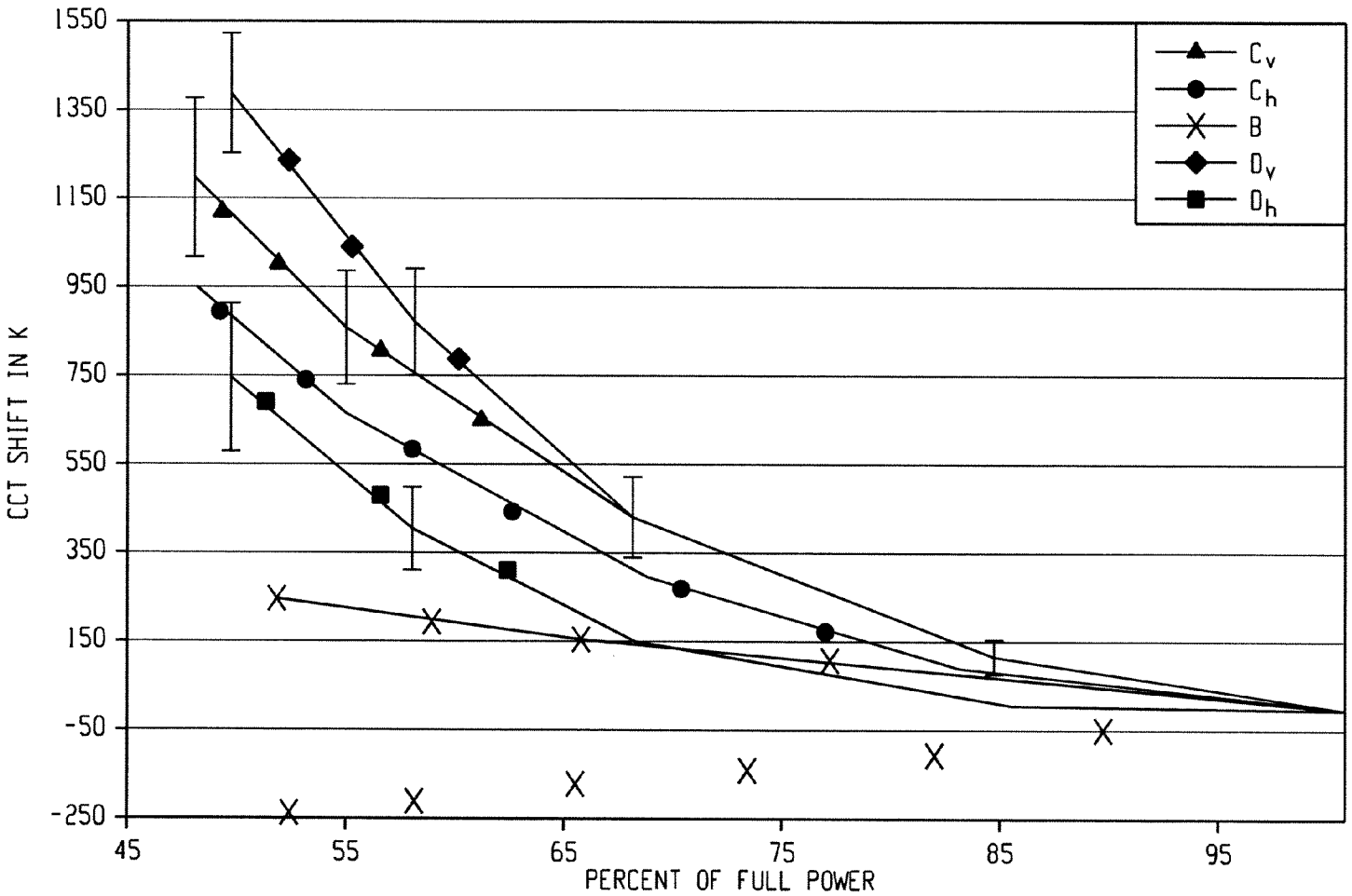
FIG. 2 is a graph showing the shift in lamp CCT, in degrees Kelvin (° K), with a reduction of the percentage of nominal lamp power for a lamp in accord with an embodiment of the invention as compared to comparable, conventional lamps.

FIG. 2 provides a graph of lamp CCT at reducing power levels for conventional 70 W and 150 W CMH lamps containing at least 4 mol % TlI, in both the horizontal and vertical burn positions (Lamps $C_v$, $C_h$, $D_v$, and $D_h$, respectively). Data is also provided for a 70 W CMH lamp (Lamp B) in accord with an embodiment of the invention. Data is provided for lamps C and D. At 100% nominal power all lamps represented exhibit a CCT of about 3000° K, elating to 0 on the graph. As operating power was reduced, the conventional lamps exhibited increased CCT from 750° K to 1350° K. This increase in CCT correlates to an undesirable shift in emission color toward green. The lamp in accord with the invention, however, exhibited a CCT of within +/−250° K of the lamp CCT at 100% operating power. This is attributed to the inclusion of less than 1 mol % TlI.

Figure 3:
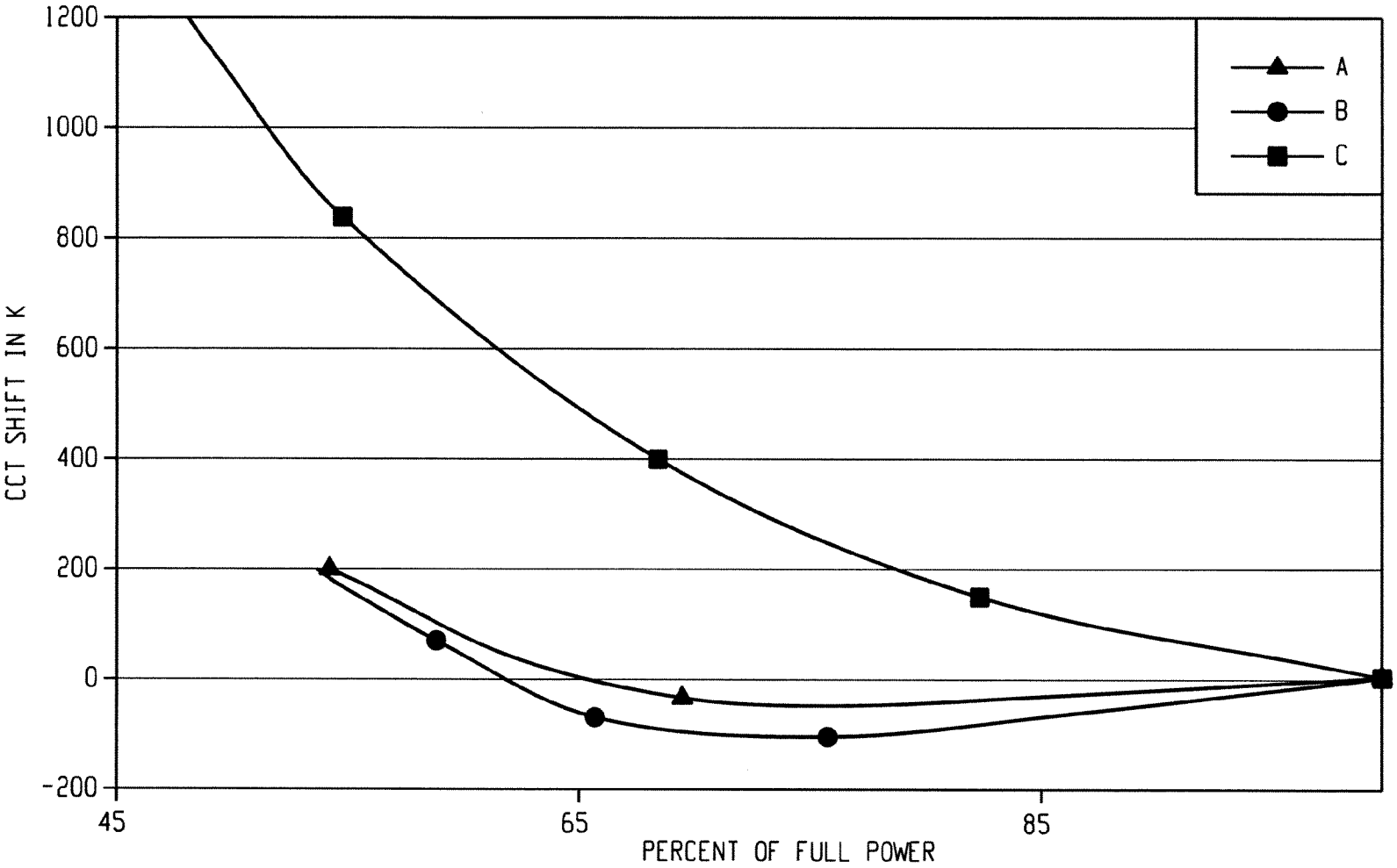
FIG. 3 is a another graph showing the shift in lamp CCT, in degrees Kelvin (° K), with a reduction of the percentage of nominal lamp power for a lamp in accord with an embodiment of the invention as compared to comparable, conventional lamps.

FIG. 3 is a graph showing CCT as a function of percentage of nominal (full) power for lamps, the fills for which are shown in Table 2 above. Lamp (A) has a dose including Ce/Sr/Na and less than 1 mol % of TlI and InI. Lamp (B) has a dose of Ce/Ca/Na and less than 1 mol % of TlI and Int. Lamp C is a conventional 70 watt ultra lamp containing a fill of Na/La/Tl/Ca, wherein TlI is included at a level greater than 1 mol % and including no indium halide. As is shown, both Lamps A and B experienced a shift in CCT of at most 200° K at 55% nominal power. In contrast, the conventional Lamp C experienced a shift in CCT of about 850° K at 55% nominal power, correlating to a color shift in lamp emission toward green.

Figure 4:
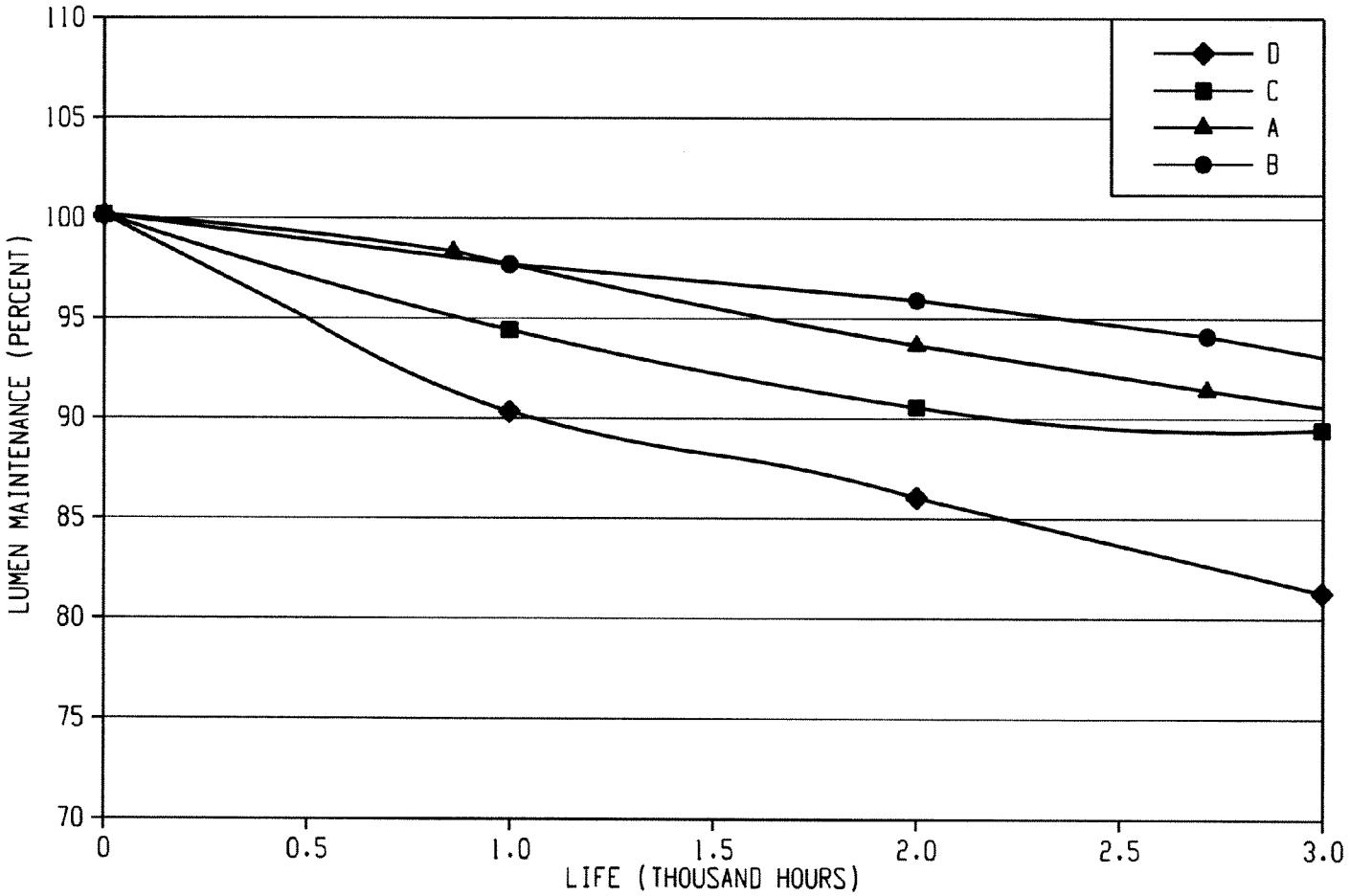
FIG. 4 is a graph showing lumen maintenance over the life of lamps in accord with the invention as compared to comparable, conventional lamps.

FIG. 4 is a graph showing the lumen maintenance, i.e. the percentage of lumen maintenance as a function of life of the lamp in thousands hours. The lumen maintenance for lamps A-D is shown. As can be seen, lamps A and B, in accord with the invention, exhibited lumen maintenance of at least about 90% after 2500 hours.

TABLE 3 provides data generated by lamps A, B, and C, having the dose shown above in TABLE 2, all rated for operation at 70 W, not only with regard to CCT but for other photometric performance parameters as well. Data is provided for two lamps having the fill in accord with Lamp B, one operated off a reference ballast and one off an electrical ballast.

TABLE 3

| | Lamp C | Lamp A | Lamp B | Lamp B |
|---|---|---|---|---|
| Volts | 94.7 | 91.8 | 92.7 | 88 |
| Watts | 72 | 72 | 72.1 | 73 |
| Lumens | 6480 | 6577 | 6662 | 6866 |
| LPW | 90 | 91.3 | 92.4 | 94 |
| CLR-X | 0.4421 | 0.4181 | 0.4182 | 0.4217 |
| CLR-Y | 0.4063 | 0.3808 | 0.3783 | 0.3749 |
| CCT | 2993 | 3151 | 3122 | 3022 |
| CRI | 87.5 | 86.2 | 87.6 | 88 |
| # Lamps | 248 | 6 | 5 | 5 |
| Ballast | reference | reference | reference | electronic |
| Ceramic | 70 W ultra | 70 W ultra | 70 W ultra | 70 W ultra |

TABLE 3 clearly shows that a lamp dose in accord with this disclosure (Lamps A and B) exhibits performance and photometric parameters equal to or better than those exhibited by a conventional lamp (Lamp C) having a halide dose including greater than 1 mol % thallium iodide and no indium iodide. More importantly, in conjunction with the data presented hereinabove it is seen that the lamp in accord with the disclosure, while performing equally or better than known lamps, further exhibits no undesirable color shift when operated under dimming conditions, i.e. at less than nominal power, and even as low as only 50% of nominal power. As such, the lamp having a halide dose in accord herewith represents a more economical lighting solution than currently available lamps.

The invention has been described with reference to the preferred embodiments. Obviously, modifications and alterations will occur to others upon reading and understanding the preceding detailed description. It is intended that the invention be construed as including all such modifications and alterations.

Having thus described the invention, it is now claimed:

1. A lamp comprising:

a discharge vessel;

electrodes operatively associated with the discharge vessel; and an ionizable fill sealed within the vessel, wherein the fill includes:

(a) an inert gas, (b) mercury, (c) less than or equal to 0.4 mol % thallium halide, and (d) a further halide component including:

(i) an alkali metal halide, (ii) an alkaline earth metal halide, and (iii) at least one of a rare earth halide selected from the group consisting of lanthanum and cerium, and optionally praseodyimium, europium, neodymium, and samarium, and combinations thereof.

2. The lamp of claim 1, further containing indium halide as less than 1 mol % of the halide dose thereof.

3. The lamp of claim 1, wherein the lamp, when operated at 50% nominal lamp power, exhibits a CCT of within +/−250° K of the CCT of the lamp when operated at 100% nominal lamp power.

4. The lamp of claim 1, wherein the lamp, when operated at 50% nominal lamp power, exhibits a CCT of within +/−100° K of the CCT of the lamp when operated at 100% nominal lamp power.

5. The lamp of claim 1, wherein the lamp exhibits lumen maintenance of at least about 85% after 3000 hours at the nominal power.

6. The lamp of claim 1, wherein the lamp exhibits lumen maintenance of at least about 93% after 3000 hours at the nominal power.

7. The lamp of claim 1, wherein the lamp exhibits greater than or equal to 90 LPW when operated at less than nominal power.

8. The lamp of claim 1, wherein the halide component includes thallium iodide, indium iodide, sodium halide, at least one of calcium or strontium halide, and at least one of cerium or lanthanum halide.

9. The lamp of claim 1, wherein all of the halide in the fill are iodides.

10. The lamp of claim 1, wherein the lamp exhibits a CRI of at least about 86 when operated at the nominal lamp power.

11. The lamp of claim 1, wherein the dose comprises an inert gas, Hg, TlI, NaI, $CaI_2$, and $LaI_3$.

12. The lamp of claim 2, wherein the dose comprises an inert gas, Hg, TlI, InI, NaI, $CaI_2$, and $LaI_3$.

13. The lamp of claim 2, wherein the dose comprises an inert gas, Hg, TlI, InI, NaI, $SrI_2$, and $LaI_3$.

14. The lamp of claim 2, wherein the dose comprises an inert gas, Hg, TlI, InI, NaI, $CaI_2$, and $CeI_3$.

15. A method of forming a lamp, comprising:

providing a discharge vessel;

sealing an ionizing fill within the vessel, wherein the fill includes:

(a) an inert gas, (b) mercury, (c) less than or equal to 0.4 mol % thallium halide and optionally less than 1 mol % indium halide, and (d) a further halide component including:

(i) an alkali metal halide, (ii) an alkaline earth metal halide, and (iii) at least one of a rare earth halide selected from the group consisting of lanthanum and cerium, and optionally praseodymium, europium, neodymium, and samarium, and combinations thereof; and positioning electrodes within the discharge vessel to energize the fill in response to a voltage applied thereto, wherein the lamp, when operated at less than 50% of its nominal lamp power, exhibits an MPCD of less than 6.

16. The method of claim 15, wherein the lamp CCT increases or decreases by no more than 250° K when operated at less than its nominal lamp power as compared to the CCT of the same lamp operated at nominal power.

17. The method of claim 15, wherein the lamp, when operated at less than 80% nominal power exhibits a shift of no more than +7-250° K in CCT from 3000° K at nominal power, a CRI of at least about 86, LPW of at least about 90, and lumen maintenance of about 93% over 3000 hours of operation.

18. The lamp of claim 1, wherein the fill includes strontium halide.

19. The lamp of claim 1, wherein the fill does not contain calcium halide.

20. The lamp of claim 1, wherein the fill does not include sodium halide.

* * * * *